US006106982A

United States Patent [19]

Mientus et al.

[11] Patent Number: 6,106,982

[45] Date of Patent: Aug. 22, 2000

[54] IMAGED RECEPTOR LAMINATE AND PROCESS FOR MAKING SAME

[75] Inventors: Bernard S. Mientus, Painesville; Mark Wisniewski, Mentor; Ramabhadran Balaji, Painesville; Kushalkumar M. Baid, Mentor; Robert O. Bucholz, Chagrin Falls, all of Ohio

[73] Assignee: Avery Dennison Corporation, Pasadena, Calif.

[21] Appl. No.: 09/075,720

[22] Filed: May 11, 1998

[51] Int. Cl.[7] ..... G03C 3/00

[52] U.S. Cl. ..... 430/14; 430/18

[58] Field of Search ..... 430/11, 14, 18

[56] References Cited

U.S. PATENT DOCUMENTS

| | | | |
|---|---|---|---|
| 4,337,303 | 6/1982 | Sahyun et al. | 430/11 |
| 4,510,225 | 4/1985 | Kuehnle | 430/126 |
| 4,888,075 | 12/1989 | Freedman | 156/243 |
| 4,891,285 | 1/1990 | Page et al. | 430/18 |
| 4,946,532 | 8/1990 | Freeman | 156/243 |
| 5,087,536 | 2/1992 | Aslam et al. | 430/14 |
| 5,104,721 | 4/1992 | Sun | 428/206 |
| 5,104,731 | 4/1992 | Gager | 428/323 |
| 5,106,710 | 4/1992 | Wang et al. | 430/42 |
| 5,126,763 | 6/1992 | Atherton et al. | 346/135.1 |
| 5,260,140 | 11/1993 | Malhotra | 430/18 |
| 5,262,259 | 11/1993 | Chou et al. | 430/47 |
| 5,306,543 | 4/1994 | Katsen | 428/195 |
| 5,363,179 | 11/1994 | Cahill et al. | 430/126 |
| 5,400,126 | 3/1995 | Cahill et al. | 430/126 |
| 5,419,960 | 5/1995 | Touhsaent | 428/331 |
| 5,435,963 | 7/1995 | Rackovan et al. | 264/509 |
| 5,437,913 | 8/1995 | Asaka et al. | 428/195 |
| 5,460,874 | 10/1995 | Rao | 428/327 |
| 5,466,551 | 11/1995 | Yuh et al. | 430/63 |
| 5,475,480 | 12/1995 | Cahill et al. | 430/126 |
| 5,516,394 | 5/1996 | Rimai et al. | 430/11 |
| 5,601,959 | 2/1997 | Brault et al. | 430/126 |
| 5,721,086 | 2/1998 | Emslander et al. | 430/126 |
| 5,827,627 | 10/1998 | Cleckner et al. | 430/18 |

*Primary Examiner*—Roland Martin
*Attorney, Agent, or Firm*—Renner, Otto, Boisselle & Sklar

[57] ABSTRACT

This invention relates to an imaged receptor laminate, comprising: a thermoplastic core layer having a first side and a second side; a thermoplastic skin layer overlying said first side of said core layer, said skin layer comprising a major amount of a thermoplastic copolymer or terpolymer derived from ethylene or propylene and a functional monomer selected from the group consisting of alkyl acrylate, acrylic acid, alkyl acrylic acid, vinyl acetate and combinations of two or more thereof, said skin layer having a melting point in the range of about 50° C. to about 120° C., said core layer having a melting point that is higher than the melting point of said skin layer; and an electrostatically formed and developed image adhered to said skin layer. In one embodiment, a dielectric layer overlies the toned image and the skin layer. In one embodiment, a conductive carrier sheet overlies the foregoing dielectric layer. In one embodiment, an overlaminate protective film layer overlies the image and the skin layer. In one embodiment, an overlaminate protective film layer overlies the dielectric layer. This invention also relates to a process for making the foregoing imaged receptor laminate.

34 Claims, 2 Drawing Sheets

IMAGED RECEPTOR LAMINATE AND PROCESS FOR MAKING SAME

TECHNICAL FIELD

This invention relates to an imaged receptor laminate and to a process for making such a laminate.

BACKGROUND OF THE INVENTION

The use of electrographic processes to form electrostatic images is well known in the art. In such processes, a latent image, in the form of applied electric charges, is produced directly on a substrate having a dielectric surface using an electrostatic printer. The printer operates by depositing charges imagewise onto the dielectric surface of the substrate using a scanning stylus or a plurality of styli arranged in linear arrays across the width of the dielectric surface to create the desired imagewise charge patterns. The substrate with the latent image applied is then passed through a toning station where an appropriately charged toner is applied to the oppositely charged surface of the substrate to produce a toned image. The toning station may include a fixing substation where the applied toner is fixed by heat or pressure or both. Color images may be generated using a plurality of serially positioned charge depositing and/or toning stations which operate sequentially to apply, for example, three or four colors to generate a colored image.

A problem for the electrographic printing industry is that there are many substrates upon which it is desirable to print. Many of these can conceivably be manufactured in forms suitable for direct electrographic imaging but their development or manufacture is uneconomical and hence they are either expensive or they are unavailable. Other substrates include those which because of their physical properties (including bulk, stiffness, low strength, elasticity, or structure) cannot be transported through an electrostatic printer and hence are completely unsuited for electrographic imaging. Thick films, papers and boards, as well as wooden, ceramic and metal surfaces are but a few examples. The ability to provide images on such substrates is desirable.

Electrographic processes for forming images on many of the above-discussed substrates which cannot be transported through a printer are known. These processes typically involve transfer of an electrostatically formed and developed image from an electrographic transfer sheet to a final substrate using polyvinyl chloride (PVC) film as an intermediate transfer medium. The electrostatically formed and developed image is formed on an electrographic transfer sheet and then transferred to the PVC film. The PVC film, with the electrostatically formed and developed image adhered to it, is then adhered to the final substrate. The PVC film that is typically used with these processes is either a calendered or dispersion cast monolayer PVC film. While the use of these PVC films has met with success in the marketplace, the PVC films have also been found to be not entirely acceptable. Neither the PVC films, nor the processes used for making such films, are environmentally friendly. The present invention, which employs the use of a unique multilayered receptor laminate that does not contain PVC, overcomes these problems.

U.S. Pat. No. 4,946,532 discloses composite facestocks and liners made of multilayer polymeric films. The multilayer film is comprised of a coextrudate containing core or base layer and skin layers overlying each side of the core layer. The core layer contains a filler material.

U.S. Pat. No. 5,106,710 discloses an electrographic process for producing a multicolored toned image in an electrostatic printer. The process disclosed therein includes the steps of: a) providing a flexible imaging sheet having a surface exhibiting dielectric properties and toner release properties; b) moving the imaging sheet through the printer; c) producing on the surface of the imaging sheet an electrostatic latent image corresponding to a desired color by imagewise deposition of charges; d) developing the latent image with a toner to form a toned image; e) drying the toned image; f) repeating steps c), d), and e) in sequence using toners corresponding to other colors to complete the multicolored toned image; and g) bringing the multicolored toned image formed on the imaging sheet in contact with a receptor sheet under pressure and at an elevated temperature, so that said image is transferred to the receptor sheet. The receptor sheet surface has a surface energy greater than the surface energy of the imaging sheet surface, and has a glass transition temperature between 10° C. and 105° C. The receptor sheet is comprised of a polymer selected from the group consisting of acrylics, polyolefins, polyvinyl acetals, PVC and polyurethane film.

U.S. Pat. No. 5,435,963 discloses an oriented polymeric in-mold label film that includes a hot-stretched, annealed, linerless self-wound film lamina. The film is disclosed as having a face layer for printing, a central layer, and a base layer which includes a heat-activatable adhesive. The working examples disclose a label film with the face layer disclosed as being a mixture of an ethylene/vinyl acetate copolymer and a polypropylene homopolymer. The central layer is disclosed as being a mixture of an ethylene/vinyl acetate copolymer, either polypropylene homopolymer or a random polypropylene copolymer, and optionally a titanium dioxide concentrate. The base layer is disclosed as being a mixture of an ethylene/vinyl acetate copolymer, either a polypropylene homopolymer or a low density polyethylene, and optionally a heat-activatable adhesive and an antistat.

U.S. Pat. No. 5,601,959 discloses a process and associated element for forming an image on a substrate using an electrographic element comprising a releasable dielectric image receptive layer supported on an electrically conductive carrier sheet by applying an adhesive coating on the substrate front surface, producing a toned image on the image receptive dielectric layer, contacting the image to the adhesive layer thereby adhering the electrographic element to the substrate, and separating and removing the carrier sheet from the image receptive layer, whereby the image receptive layer and the toned image remain on the substrate.

SUMMARY OF THE INVENTION

This invention relates to an imaged receptor laminate, comprising: a thermoplastic core layer having a first side and a second side; a thermoplastic skin layer overlying said first side of said core layer, said skin layer comprising a major amount of a thermoplastic copolymer or terpolymer derived from ethylene or propylene and a functional monomer selected from the group consisting of alkyl acrylate, acrylic acid, alkyl acrylic acid, vinyl acetate and combinations of two or more thereof, said skin layer having a melting point in the range of about 50° C. to about 120° C., said core layer having a melting point that is higher than the melting point of said skin layer; and an electrostatically formed and developed image adhered to said skin layer. In one embodiment, the functional monomer is selected from the group consisting of alkyl acrylate, acrylic acid, alkyl acrylic acid, and combinations of two or more thereof. In one embodiment, a dielectric layer overlies the electrostatically formed and developed image and the skin layer.

In one embodiment, a conductive carrier sheet overlies the foregoing dielectric layer. In one embodiment, an overlaminate protective film layer overlies the image and the skin layer. In one embodiment, an overlaminate protective film layer overlies the dielectric layer.

In one embodiment, the imaged receptor laminate has another skin layer overlying the second side of the core layer, said another skin layer comprising a major amount of a thermoplastic copolymer or terpolymer derived from ethylene or propylene and a functional monomer selected from the group consisting of alkyl acrylate, acrylic acid, alkyl acrylic acid, vinyl acetate and combinations of two or more thereof, said another skin layer having a melting point in the range of about 50° C. to about 120° C., said core layer having a melting point that is higher than the melting point of said another skin layer. In one embodiment, the functional monomer is selected from the group consisting of alkyl acrylate, acrylic acid, alkyl acrylic acid, and combinations of two or more thereof. When skin layers are used on both sides of the core layer, the composition and/or dimensions of the two skin layers can be the same or substantially the same or they can be different.

In one embodiment, a tie layer of an adhesive resin is positioned between the core layer and the skin layer. When skin layers are used on both sides of the core layer, tie layers can be used between the core layer and either or both skin layers. When a skin layer is used on only one side of the core layer, a tie layer may be used on either or both sides of the core layer.

In one embodiment, a pressure sensitive or heat-activatable adhesive is adhered to the second side of the core layer or to the skin layer overlying the second side of the core layer, if such a skin layer is used. In one embodiment, a release coated substrate is adhered to the pressure sensitive or heat-activatable adhesive. The release coated substrate comprises a substrate (e.g., paper, polymer film, etc.) and a layer of a cured release coating composition adhered to one side of the substrate. The release coating composition is positioned between the pressure sensitive or heat-activatable adhesive and,the substrate.

In one embodiment, the invention relates to a process for making an imaged receptor laminate, comprising the steps of: (A) forming and developing an electrostatically formed image on an electrographic transfer sheet, said electrographic transfer sheet comprising a dielectric layer supported on a conductive carrier sheet, said electrostatically formed and developed image being formed and developed on said dielectric layer; and (B) contacting the imaged side of said electrographic transfer sheet against a receptor laminate, said receptor laminate having a thermoplastic skin layer overlying a thermoplastic core layer, said skin layer comprising a major amount of a thermoplastic copolymer or terpolymer derived from ethylene or propylene and a functional monomer selected from the group consisting of alkyl acrylate, acrylic acid, alkyl acrylic acid, vinyl acetate and combinations of two or more thereof, said skin layer having a melting point in the range of about 50° C. to about 120° C., said core layer having a melting point that is higher than the melting point of said skin layer, said electrostatically formed and developed image adhering to said skin layer. In one embodiment, said dielectric layer is separated from said electrostatically formed and developed image. In one embodiment, said dielectric layer adheres to said electrostatically formed and developed image. In one embodiment, said conductive carrier sheet is separated from said dielectric layer.

An advantage of this invention is that the multilayered receptor laminate provided for herein offers the same or improved capabilities relative to PVC films used in the prior art, yet also provides for the use of receptor laminates that are environmentally friendly in both their use and production.

These receptor laminates are outdoor weatherable and provide for a higher bonding strength between the electrostatically formed and developed image and the receptor laminate surface than do the prior art PVC films.

BRIEF DESCRIPTION OF THE DRAWINGS

In the annexed drawings, like references indicate like parts or features.

The receptor laminate includes a thermoplastic core layer having a first side and a second side, a first thermoplastic skin layer overlying the first side of the core layer, and a second thermoplastic skin layer overlying the second side of the core layer. An electrostatically formed and developed image is adhered to the first skin layer, and a dielectric layer overlies the image and the first skin layer. An overlaminate protective film layer overlies the dielectric layer. The overlaminate protective film layer is comprised of a thermoplastic film adhered to the dielectric layer by an adhesive layer. A layer of another pressure sensitive or heat-activatable adhesive is adhered to the second skin layer, and a release coated substrate overlies this pressure sensitive or heat-activatable adhesive layer.

Figure 10:
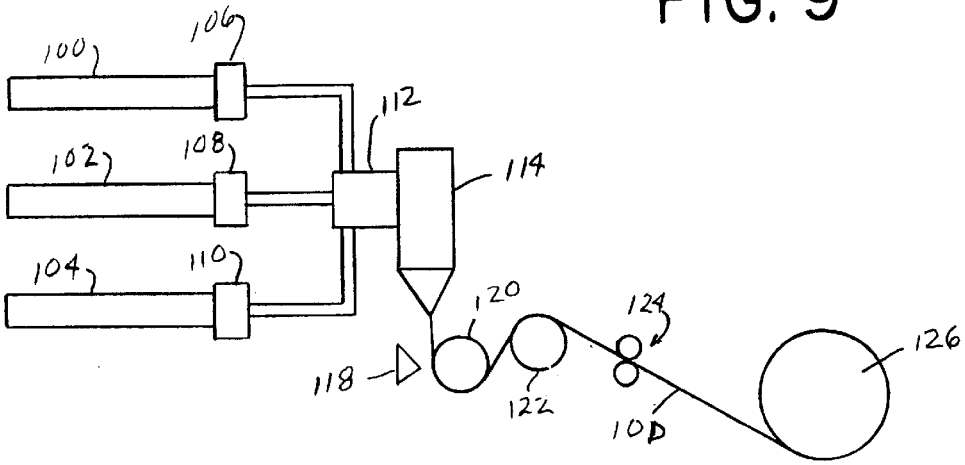

FIG. 10 is a flow sheet illustrating an extrusion process for making a receptor laminate.

Figure 11:
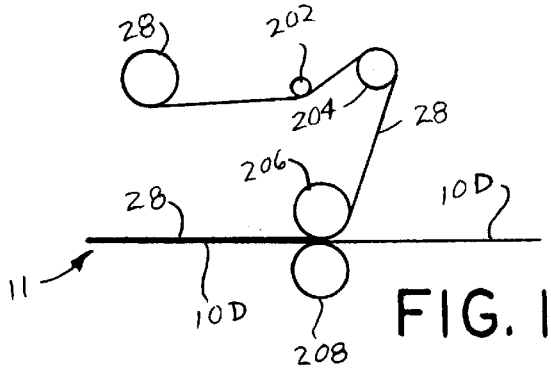

FIG. 11 is a flow sheet illustrating a process for making an imaged receptor laminate.

DESCRIPTION OF THE PREFERRED EMBODIMENTS

The imaged receptor laminate of this invention is, in one embodiment, made by forming and developing an electrostatic image on an electrographic transfer sheet, and then contacting the electrographic transfer sheet and a receptor laminate to transfer the image to the receptor laminate and thereby form the desired imaged receptor laminate. The electrostatically formed and developed image can be a toned image. The image can be in any form, including print, designs, and combinations thereof. The image can be in black, white or any desired color or combination of colors.

The Electrographic Transfer Sheet

The electrographic transfer sheet (depicted, for example, as item 28 in FIG. 6) is comprised of a dielectric layer which overlies a conductive carrier sheet. The dielectric layer can be an image receptive dielectric layer. An electrostatically formed and developed image is formed on the side of the dielectric layer opposite the side that is in contact with the carrier sheet. The dielectric layer is transparent or substantially transparent. In one embodiment, the dielectric layer is releasable. The term "releasable" is used herein to refer to the fact that the dielectric layer adheres to the conductive carrier sheet with adhesion in a range sufficiently high enough to permit handling of the electrographic transfer sheet through the process of generating an electrostatically formed and developed image thereon and subsequent adhering of said developed image to the receptor laminate without failure of the adhesion between the dielectric layer and layers adhered to said dielectric layer, and with adhesion in a range sufficiently low enough to permit removal of the carrier sheet from the dielectric layer after the electrographic transfer sheet is adhered to the receptor laminate pursuant to the inventive process; see, for example, FIG. 2 wherein dielectric layer 20 and electrostatically formed and developed image 22 are adhered to skin layer 14.

In one embodiment, the electrographic transfer sheet is comprised of a conductive carrier sheet, a dielectric layer overlying the conductive carrier sheet, a release coating layer overlying the dielectric layer, and an electrostatically formed and developed image formed on the release coating layer. The release coating layer can be comprised of any of the release coating compositions referred to below under the subtitle "Pressure Sensitive Adhesive Structure." These include polyorganosiloxanes (e.g., polydimethyl siloxanes), urethane-silicone polymers, epoxy silicone polymers, acrylic-silicone polymers, and the like. With this embodiment, the carrier sheet as well as the dielectric layer can be removed from the electrostatically formed and developed image after the electrographic transfer sheet is adhered to the receptor laminate pursuant to the inventive process; see, for example, FIG. 1 wherein electrostatically formed and developed image 22 is adhered to skin layer 14 and no dielectric layer is present.

The dielectric layer can be comprised of any film forming polymer used for providing dielectric layers for electrographic transfer printing. These include but are not limited to polyester, polyvinyl acetate, polyvinyl chloride, polyvinyl butyral, polymethylmethyacrylate, styrenated acrylic, ethylene-vinyl alcohol copolymer, styrene-acrylonitrile copolymer, or a combination of two or more thereof. The dielectric layer may include other additives known to those skilled in the art.

The conductive carrier sheet can be comprised of a substrate having a conductive layer adhered to or applied to one or both sides of the substrate. The substrate may be comprised of paper, polymer film or a combination thereof. The paper, polymer film or combination that may be used as the substrate may be any of the substrates discussed below under the subtitle "Pressure Sensitive or Heat-Activatable Adhesive Structure." The conductive layer may be comprised of a binder and a conductive material. The binder may be any binder used for electrographic printing including the polymeric binders selected from the group consisting of anionic polymer, polystyrene sulfonic acid, styrene-acrylate copolymer, polymeric quaternary ammonium compound, acrylic resin, acrylic copolymer resin, polyvinyl alcohol, cellulose resin, styrene-maleic anhydride copolymer, polyvinyl pyrrolidone, or a combination of two or more thereof. The conductive material may be any conductive material used for electrographic printing including the conductive materials selected from the group consisting of antimony doped tin oxide, copper iodide, indium doped tin oxide, graphite, conductive clay, or a combination of two or more thereof. The conductive layer may include other additives known to those skilled in the art.

The electrostatically formed and developed image that is formed on the dielectric layer is, in one embodiment, a toner ink comprised of a binder, or one or more pigments and/or dyes dispersed in a binder. The pigment and/or dye may be any pigment or dye used for electrographic printing including carbon black, black pigment and/or dye, cyan pigment and/or dye, magenta pigment and/or dye, yellow pigment and/or dye, spot color pigment and/or dye, or a combination of two or more thereof. The binder may be any binder used in making toner for electrographic printing. These include the polymers selected from the group consisting of polyvinyl butyral resin, styrene resin, styrene-acrylic copolymer, styrene-butadiene copolymer, alkyd resin, rosin modified phenol resin, ethyl acrylate copolymer, polymethylacrylate resin, polyvinyl acetate resin, hydroxyethyl methacrylate resin, poly laurylmethacrylate copolymer, ionic polyester, and mixtures of two or more thereof. Toner inks that are useful include those available from Xerox under the trade designations Hi-Brite and Turbo.

Electrographic transfer sheets that are useful include those available from Minnesota Mining and Manufacturing Company (3M) under the trade designation 3M Image Transfer Media, Rexam Graphics under the trade designation Dry Transfer Grade, and Sihi under the trade designation Sihl UPG85.

The electrostatically formed image is created on the dielectric layer of the electrographic transfer sheet using known procedures. For example, this may be done using an electrographic printer which typically may comprise an image source, which may be a computer, and a mechanical arrangement for generating an image on an electrographic transfer sheet. The computer in addition to providing image information to the printing station of the printer may also control all functions of the printer, including driving the electrographic sheet through an imaging station which generally comprises an array of styli. The computer addresses the styli and instructs them to deposit a predetermined amount of charge on the image receptive surface of the electrographic transfer sheet. A latent image in the form of a charge distribution is thus formed on the image receptive surface of the electrographic transfer sheet.

The electrographic transfer sheet is next transported through a toning station where an appropriate toner is applied to the image receptive surface to develop a toned image. The toning station may include a fixing substation where the applied toner is fixed by heat or pressure or both on the image receptive surface.

When a colored image is desired to be reproduced the above process is repeated with additional toners of different colors, in either sequentially arranged imaging and toning stations or by passing the element under the same imaging station and alternately applying each toner. Color reproduction usually requires three and often four different color toners to render a pleasing and accurate facsimile of an original color image. The selection of toner colors and the creation of the different images whose combination will provide such accurate rendition of an original image is well known in the art.

In one embodiment, the electrographic transfer sheet has a thickness in the range of about 1 mil to about 10 mils, and in one embodiment about 1.5 mils to about 5 mils, and in one embodiment about 2 mils to about 4 mils, and in one embodiment about 2.7 mils to about 2.85 mils.

The Receptor Laminate

The receptor laminate (depicted, for example, as item 10 in FIGS. 1 and 8; item 10A in FIG. 2; item 10B in FIG. 3; item 10C in FIG. 4; or item 10D in FIGS. 5–7) is comprised of a thermoplastic core layer having a first side and a second side, and a thermoplastic skin layer overlying the first side of the core layer. In one embodiment, another skin layer overlies the second side of the core layer. In one embodiment, a tie layer of an adhesive resin is positioned between the core layer and either or both of the foregoing skin layers. In one embodiment, a tie layer of an adhesive is positioned between the first side of the core layer and the skin layer overlying such first side, and another tie layer of an adhesive is adhered to the second side of the core layer.

The core layer may comprise a single layer or a multilayer structure. The core layer is comprised of a thermoplastic polymer that can be a polyethylene, polypropylene, polybutylene, polyethylene methyl acrylic acid, polyethylene ethyl acrylate, metallocene catalyst catalyzed polyolefins, polystyrene, polyethylene methyl acrylate, acrylonitrile,-butadiene-styrene polymer, polyethylene vinyl alcohol, polyethylene vinyl acetate, nylon, polyurethane, polycarbonate, styrene maleic anhydride polymer, styrene acrylonitrile polymer, sodium or zinc containing ethylene/methacrylic acid copolymers (sometimes referred to as ionomers), polymethyl methacrylates, polybutylene terephthalate, polyethylene terephthalate, thermoplastic polyesters, or mixture of two or more thereof.

In one embodiment, the core layer is comprised of a polyolefin, such as low, medium, or high density: polyethylene, polypropylene or polybutylene or copolymers of ethylene, propylene or butylene with an alpha olefin. The alpha olefin, is selected from those alpha olefins containing from 2 to about 18 carbon atoms, and in one embodiment 2 to about 10 carbon atoms, including ethylene, butylene, hexene and octene. The polyolefin may be prepared using a metallocene catalyst. An example of a useful propylene homopolymer is available from Union Carbide under the trade designation 5A97, which is identified as a polypropylene having a melting point of 162° C. The propylene copolymers that are useful include random propylene copolymers which contain about 3% to about 5% by weight ethylene. Affinity 1031HF, which is a product of Dow Chemical identified as a metallocene catalyst catalyzed octene-ethylene copolymer polyethylene having a melting point of 121° C., can be used. Lyondell M6060, which is a product of Lyondell Petrochemical Company identified as a high density polyethylene having a melting point of 136° C., can be used.

The thermoplastic polymer used in the core layer has a melting point that is higher than melting point of the copolymer or terpolymer used in the skin layers. This melting point differential is necessary in order to provide the core layer with sufficient heat resistance properties to avoid melting during the thermal transfer imaging and printing processes for which the film is to be used. The melting point of the thermoplastic polymer used in the core layer is generally in the range of about 100° C. to about 165° C., and in one embodiment about 110° C. to about 165° C. In one embodiment, the melting point of the thermoplastic polymer in the core layer exceeds the melting point of the copolymer or terpolymer used in the skin layers by about 10° C. to about 250° C., and in one embodiment about 25° C. to about 100° C.

The concentration of the thermoplastic polymer in the core layer is generally at least about 30% by weight, and in one embodiment about 30% to about 90% by weight, and in one embodiment about 60% to about 80% by weight.

The core layer may be clear in appearance or it may be pigmented. The pigments that can be used include titanium dioxide, both rutile and anatase crystal structure. In one embodiment, the pigment is added to the core layer material in the form of a concentrate containing the pigment and a resin carrier. The concentrate may contain, for example, about 20% to about 80% by weight pigment, and about 20% to about 80% by weight resin carrier. The resin carrier can be any thermoplastic polymer having a melting point in the range of about 100° C. to about 265° C. Examples include polyethylene, polypropylene, polybutylene, polyester, nylon and the like. In one embodiment, a titanium dioxide concentrate is used which is comprised of a blend of about 30% to about 70% by weight polypropylene and about 70% to about 30% by weight titanium dioxide. An example of a commercially available pigment concentrate that can be used is available from A. Schulman Inc. under the tradename PolyBatch White P8555 SD, which is identified as a white color concentrate having a coated rutile titanium dioxide concentration of 50% by weight in a polypropylene homopolymer carrier resin. Another example is Ampacet 110233 which is a product of Ampacet Corporation identified as a $TiO_2$ concentrate containing 50% rutile $TiO_2$ and 50% low density polyethylene. The concentration of pigment in the core layer can be up to about 25% by weight, and when used is generally in the range of about 5% to about 25% by weight, and in one embodiment about 10% to about 20% by weight, and in one embodiment about 13.5% by weight.

In one embodiment, the core layer contains a minor amount of at least one nucleating agent to provide enhanced dimensional stability to the receptor laminate. In one embodiment, the addition of such nucleating agent reduces or eliminates buckling or wrinkling of the pressure sensitive or heat-activatable adhesive structure made with such receptor laminate. The need for such nucleating agent is particularly apparent in such pressure sensitive or heat-activatable adhesive structures made with such receptor laminates when said structures are larger than hand sheets, said hand sheets typically being of a size measuring about 8.5 inches by about 11 inches. Examples of such nucleating agents include dibenzidiene sorbitol, sodium benzoate and carboxylic acids. Examples of commercially available nucleating agents that are useful include Millad 3988 (a product of Milliken Chemicals identified as a sorbitol based clarifying agent for polyolefins); Schulmann 8588 NAP concentrate (a product of A. Schulmann identified as a concentrate containing dibenzidiene sorbitol); Sodium Benzoate 325 Mesh Powder and Sodium Benzoate Ultra Fine Powder (both being products of Mallinchrodt Catalyst and Chemical Additives Division identified as sodium benzoate powder); and Moldpro 931 and Moldpro 932 (both being products of Witco Corporation identified as carboxylic acid mixtures). The concentration of these nucleating agents in the core layer can be up to about 6% by weight, and in one embodiment about 0.5% to about 6% by weight, and in one embodiment about 0.5% to about 5% by weight, and in one embodiment about 0.5% to about 3% by weight.

The skin layer or layers may comprise a major amount of a thermoplastic copolymer or terpolymer derived from ethylene or propylene (preferably ethylene) and a functional monomer selected from the group consisting of alkyl acrylate, acrylic acid, alkyl acrylic acid, vinyl acetate and combinations of two or more thereof. In one embodiment, the functional monomer is selected from the group consisting of alkyl acrylate, acrylic acid, alkyl acrylic acid, and combinations of two ore more thereof. In one embodiment, the skin layer or layers are characterized by the absence of ethylene vinyl actetate resins, and acid or acid/acrylate-modified ethylene vinyl acetate resins. The alkyl groups in the alkyl acrylates and the alkyl acrylic acids typically contain 1 to about 8 carbon atoms, and in one embodiment 1 to about 2 carbon atoms. The copolymer or terpolymer generally has a melting point in the range of about 50° C. to about 120° C., and in one embodiment about 60° C. to about 110° C. The functional monomer(s) component of the copolymer or terpolymer ranges from about 1 to about 15 mole percent, and in one embodiment about 1 to about 10 mole percent of the copolymer or terpolymer molecule. Examples include: ethylene/vinyl acetate copolymers; ethylene/methyl acrylate copolymers; ethylene/ethylacrylate copolymers; ethylene/butyl acrylate copolymers; ethylene/methacrylic acid copolymers; ethylene/acrylic acid copolymers; ethylene/methacrylic acid copolymers containing sodium or zinc (also referred to as ionomers); acid-, anhydride- or acrylate-modified ethylene/vinyl acetate copolymers; acid- or anhydride-modified ethylene/acrylate copolymers; anhydride-modified low density polyethylenes; anhydride-modified linear low density polyethylene, and mixtures of two or more thereof. In one embodiment, ethylene/vinyl acetate copolymers that are particularly useful include those with a vinyl acetate content of at least about 20% by weight, and in one embodiment about 20% to about 40% by weight, and in one embodiment about 22% to about 28% by weight, and in one embodiment about 25% by weight.

Examples of commercially available copolymers and terpolymers that can be used include the ethylene/vinyl acetate copolymers available from DuPont under the tradename Elvax. These include Elvax 3120, which has a vinyl acetate content of 7.5% by weight and a melting point of 99° C., Elvax 3124, which has a vinyl acetate content of 9% by weight and a melting point of 77° C., Elvax 3150, which has a vinyl acetate content of 15% by weight and a melting point of 92° C., Elvax 3174, which has a vinyl acetate content of 18% by weight and a melting point of 86° C., Elvax 3177, which has a vinyl acetate content of 20% by weight and a melting point of 85° C., Elvax 3190, which has a vinyl acetate content of 25% by weight and melting point of 77° C., Elvax 3175, which has a vinyl acetate content of 28% by weight and a melting point of 73° C., Elvax 3180, which has a vinyl acetate content of 28% by weight and a melting point of 70° C., Elvax 3182, which has a vinyl acetate content of 28% by weight and a melting point of 73° C., and Elvax 3185, which has a vinyl acetate content of 33% by weight and a melting point of 61° C., and Elvax 3190LG, which has a vinyl acetate content of 25% by weight, a melting point of about 77° C. and a glass transition temperature ($T_g$) of about −38.6° C. Ionomer resins available from DuPont under the tradename Surlyn can also be used. These are identified as being derived from sodium, lithium or zinc and copolymers of ethylene and methacrylic acid. These include Surlyn 1601, which is a sodium containing ionomer having a melting point of 98° C., Surlyn 1605, which is a sodium containing ionomer having a melting point of about 90° C. and a $T_g$ of about −20.6° C., Surlyn 1650, which is a zinc containing ionomer having a melting point of 97° C., Surlyn 1652 which is a zinc containing ionomer having a melting point of 100° C., Surlyn 1702, which is a zinc containing ionomer having a melting point of 93° C., Surlyn 1765-1, which is a zinc containing ionomer having a melting point of 95° C., Surlyn 1707, which is a sodium containing ionomer having a melting point of 92° C., Surlyn 1802, which is a sodium containing ionomer having a melting point of 99° C., Surlyn 1855, which is a zinc containing ionomer having a melting point of 88° C., Surlyn 1857, which is a zinc containing ionomer having a melting point of 87° C., and Surlyn 1901, which is a sodium containing ionomer having a melting point of 95° C. Ethylene acid copolymers available from DuPont under the tradename Nucrel can also be used. These include Nucrel 0407, which has a methacrylic acid content of 4% by weight and a melting point of 109° C., and Nucrel 0910, which has a methacrylic acid content of 8.7% by weight and a melting point of 100° C. The ethylene/acrylic acid copolymers available from Dow Chemical under the tradename Primacor are also useful. These include Primacor 1430, which has an acrylic acid monomer content of 9.5% by weight, a melting point of about 97° C. and a $T_g$ of about −7.7° C. The ethylene/methyl acrylate copolymers available from Chevron under the tradename EMAC can be used. These include EMAC 2205, which has a methyl acrylate content of 20% by weight and a melting point of 83° C., and EMAC 2268, which has a methyl acrylate content of 24% by weight, a melting point of about 74° C. and a $T_g$ of about −40.6° C.

The concentration of the foregoing thermoplastic copolymers or terpolymers in the skin layer or layers is generally at least about 25% by weight, and in one embodiment at least about 50% by weight, and in one embodiment about 50% to about 100% by weight, and in one embodiment about 60% to about 95% by weight, and in one embodiment about 85% to about 92% by weight.

The core layer and skin layer or layers may, and preferably do, contain ultraviolet light absorbers or other light stabilizers. These additives are included to prevent degradation due to sunlight. One useful type of stabilizer is a hindered amine light stabilizer. Hindered amine light stabilizers are described in the literature such as in U.S. Pat. No. 4,721,531, columns 4 to 9, which are incorporated herein by reference. The hindered amine light stabilizers may, for example, be derivatives of 2,2,6,6-tetraalkyl piperidines or substituted piperizinediones. A number of hindered amine light stabilizers useful in the invention are available commercially such as from Ciba-Geigy Corporation under the general trade designations "Tinuvin" and "Chimassorb", and from Cytec under the general designation "Cyasorb-UV." Examples include Tinuvin 111 which is identified as a mixture of 1,3,5-Triazine-2,4,6-triamine, N,N"'-[1,2-ethanediylbis[[[4,6-bis[butyl(1,2,2,6,6-pentamethyl-4-piperidinyl)amino]-1,3,5-triazin-2-yl]imino]-3,1 propanediyl]]-bis[N',N"-dibutyl-N',N"-bis (1,2,2,6,6-pentamethyl-4-piperidinyl)-and dimethyl succinate polymer with 4-hydroxy-2,2,6,6, -tetramethyl-1-piperidineethanol; Tinuvin 123 which is identified as bis-(1-octyloxy-2,2,6,6-tetramethyl-4-piperidinyl) sebacate; Tinuviri 770 which is identified as bis-(2,2,6,6-tetramethyl-4-piperidinyl)-sebacate; Tinuvin 765 which is identified as bis-(1,2,2,6,6-pentamethyl-4-piperidinyl)-sebacate; Tinuvin 622 which is a dimethyl succinate polymer with 4-hydroxy-2,2,6,6, -tetramethyl-1-piperidineethanol; and Chimassorb 944 which is poly[[6-(1,1,3,3-tetramethylbutyl) amino]-1,3,5-triazine-2,4-diyl][[2,2,6,6-tetramethyl-4-piperidyl)iminol] hexamethylene (2,2,6,6-tetramethyl-4-piperidyl)imino]], and Chimassorb 119 which is identified as being 1,3,5-Triazine-2,4,6-triamine-N',N"-[1,2-ethanediylbis[[[4.6-bis [butyl(1,2,2,6,6-pentamethyl-4-peperidinyl)amino]-1,3,5-triazin-2-yl]imino]-3,1 propanediyl]]-bis[N',N"-dibutyl-N', N"-bis (1,2,2,6,6-pentamethyl-4-piperidinyl)-. A useful stabilizer is available under the tradename Ampacet 10561 which is a product of Ampacet identified as a UV stabilizer concentrate containing 20% by weight of a UV stabilizer and 80% by weight of a low density polyethylene carrier resin. The concentration of UV absorber or light stabilizer in the core and skin layers can be up to about 2.5% by weight, and in one embodiment is about 0.05% to about 1% by weight.

The skin layer or layers may contain slip additives. These include primary amides such as stearamide, behenamide, oleamide, erucamide, and the like; secondary amides such as stearyl erucamide, erucyl erucamide, oleyl palmitamide, stearyl stearamide, erucyl stearamide, and the like; ethylene bisamides such as N,N'-ethylenebisstearamide, N,N'-ethylenebisolemide and the like; and combinations of any two or more of the foregoing amides. The slip additive can be used at a concentration in the range of up to about 2% by weight, and in one embodiment about 0.05% to about 2% by weight, and in one embodiment about 0.1% to about 0.5% by weight.

The skin layer overlying the second side of the core layer (e.g., skin layer 16 in FIGS. 3, 5, 6 and 7) may contain an antiblock additive. These include natural silica, diatomaceous earth, synthetic silica, glass spheres, ceramic particles, calcium carbonate particles, calcium silicate particles, fatty amide particles, aluminum silicate, and the like. Examples of commercially available antiblock additives include those available from A. Schulman under the trade designation CABL 4040 which is identified as solid pellets containing 5% silicate, 5% ceramic microspheres and the remainder being a low density polyethylene. Other useful additives include those available from Zeelan Industries under the trade designation Zeeospheres; 3M under the trade designation Scotchlite Glass Bubbles; Potters Industries under the trade designation Spheriglass; Mo-Sci Corporation under the trade designation Precision Glass Spheres (Class IV); Huber under the trade designation Huber Q; Nyco Minerals under the trade designations Nycor, Nyad, Ultrafibe, Primglos, Nyglos and Wallastocoat; Jayco under the trade designation Dragonite; Witco under the trade designation Kenamide; and U.S. Silica under the trade designation Min-U-Sil. The antiblock additive can be used at a concentration of up to about 10% by weight, and in one embodiment about 0.1% to about 10% by weight, and in one embodiment about 0.5% to about 3% by weight.

The antiblock and slip additives may be added together in the form of a resin concentrate. An example of such a concentrate is available from DuPont under the tradename Elvax CE9619-1. This resin concentrate contains 20% by weight silica, 7% by weight of an amide slip additive, and 73% by weight of Elvax 3170 (a product of DuPont identified as an ethylene/vinyl acetate copolymer having a vinyl acetate content of 18% by weight).

The core layer and/or skin layer or layers may contain a minor amount of an adhesive resin to enhance the adhesion of the skin layer or layers to the core layer. Also, or alternatively, tie layers of an adhesive resin can be positioned between the core layer and either or both of the skin layers for enhancing adhesion. The adhesive resin can be any of the ethylene/vinyl acetate copolymers referred to above. These include DuPont Elvax 3170 and 3190LG. The adhesive resins available from DuPont under the tradename Bynel can also be used. These include ethylene/vinyl acetate resins available under the trade designation Series 1100, acid-modified ethylene acrylate polymers (Series 2000), anhydride-modified ethylene acrylate copolymers (Series 2100), anhydride-modified ethylene/vinyl acetate copolymers (Series 3000), acid- and acrylate-modified ethylene/vinyl acetate resins (Series 3100), anhydride-modified ethylene/vinyl acetate copolymers (Series 3800), anhydride-modified ethylene/vinyl acetate resins (Series 3900), anhydride-modified high density polyethylene resins (Series 4000), anhydride-modified linear low density polyethylene resins (Series 4100), anhydride modified low density polyethylene resins (Series 4200), and anhydride modified polypropylene resins (Series 5000). Bynel CXA 1123, an ethylene/vinyl acetate copolymer having a melting point of 74° C., and Bynel CXA 3101, an ethylene based polymer containing ester and acidic comonomer functionality and having a melting point of 87° C., can be used. When included in the core layer, the adhesive resin is used at a concentration of up to about 40% by weight, and in one embodiment about 5% to about 25% by weight. When used in the skin layer or layers, the adhesive resin is used at a concentration of up to about 45% by weight, and in one embodiment about 10% to about 30% by weight. When used in the form of a film layer or layers between the core layer and the skin layer or layers, each of such adhesive resin film layer or layers has a thickness of about 5% to about 40% of the thickness of the core layer, and in one embodiment about 10% to about 25%.

The receptor laminate may have an overall thickness ranging from about 1 mil to about 25 mils, and in one embodiment about 2 mils to about 20 mils, and in one embodiment about 2 mils to about 5 mils. The thickness of the core layer may range from about 10% to about 90% of the overall thickness of the receptor laminate, and in one embodiment from about 20% to about 80%, with the combined thickness of the skin layer or layers (with or without adhesive or tie layers positioned between the core layer and the skin layer or layers) making up the remainder. In one embodiment, the thickness of the skin/core/skin layers is 10%/80%/10%, and in one embodiment it is 20%/60%/20%. When skin layers are used on each side of the core layer, such skin layers may be of the same thickness or they may have different thicknesses. Preferably, the skin layers have the same or substantially the same thickness. Similarly, each of the skin layers may have the same composition or they may have different compositions. Preferably, each of the skin layers have the same composition.

The receptor laminate may be made using a polymeric coextrusion process. The coextrudate of polymeric film materials is formed by simultaneous extrusion from two or more extruders and a suitable known type of coextrusion die whereby the core layer and the skin layer or layers are adhered to each other in a permanently combined state to provide a unitary coextrudate. As indicated above, a tie layer or layers of an adhesive resin can be included in the image receptive laminate and such tie layer or layers can be coextruded with the core layer and the skin layer or layers. The coextrusion processes for making these laminates are well known in the art.

In one embodiment, the $T_g$ of each layer used in the receptor laminate is below 10° C., and in one embodiment below about 8° C., and in one embodiment below about 5° C., and in one embodiment below about 2° C., and in one embodiment below about 0° C. In one embodiment, each layer of polymeric material used in the receptor laminate is not stress oriented.

An advantage of the present invention is that the receptor laminates that are employed can be used over a wide range of lamination temperatures, and they are easy to process. These receptor laminates do not contain PVC and thus avoid the environmental problems of both making and using laminates or films containing PVC. These receptor laminates are highly resistant to degradation resulting from sunlight, and provide for a higher bonding strength between the electrostatically formed and developed image and the laminate surface than do prior art PVC films.

Pressure Sensitive or Heat-Activatable Adhesive Structure

In one embodiment, the present invention provides for a pressure sensitive or heat-activatable adhesive structure or product wherein the imaged receptor laminate has a pressure sensitive or heat-activatable adhesive composite adhered to it. The pressure sensitive or heat-activatable adhesive composite is depicted, for example, as item 30 in FIG. 5 or item 39 in FIG. 6. The pressure sensitive or heat-activatable adhesive composite includes a layer of a pressure sensitive or heat-activatable adhesive applied to a substrate. In one embodiment the substrate is a release coated substrate or release liner. The release coated substrate or release liner is comprised of a substrate or backing liner and a layer of a cured release coating composition adhered to one or both sides of the substrate or backing liner. The release coating is positioned between the pressure sensitive or heat-activatable adhesive and the substrate. The pressure sensitive or heat-activatable adhesive is applied to the second side of the core layer, or if a skin layer is adhered to the second side of the core layer the adhesive is applied to such skin layer. If a tie layer is adhered to the second side of the core layer and no skin layer is adhered to such tie layer, the adhesive can be applied to such tie layer.

The release coating composition can be any release coating composition known in the art. Silicone release coating compositions are preferred, and any of the silicone release coating compositions which are known in the art can be used. The major component of the silicone release coating is a polyorganosiloxane and more often, polydimethylsiloxane. The silicone release coating compositions used in this invention may be room temperature cured, thermally cured, or radiation cured. Generally, the room temperature and thermally curable compositions comprise at least one polyorganosiloxane and at least one catalyst (or curing agent) for such polyorganosiloxane(s). Such compositions may also contain at least one cure accelerator and/or adhesion promoter (sometimes referred to as an anchorage additive). As is known in the art, some materials have the capability of performing both functions, i.e., the capability of acting as a cure accelerator to increase the rate, reduce the curing temperature, etc., and also as an adhesion promoter to improve bonding of the silicone composition to the substrate. The use of such dual function additives where appropriate is within the purview of the invention.

The release coating compositions are applied to the substrate using known techniques. These include gravure, reverse gravure, offset gravure, roller coating, brushing, knife-over roll, metering rod, reverse roll coating, doctor knife, dipping, die coating, spraying curtain coating, and the like. The coat weight is in the range of about 0.1 grams per square meter (gsm) to about 10 gsm or more, and in one embodiment about 0.3 gsm to about 2 gsm. In one embodiment, the thickness or caliper of the resulting release-coated substrate may range from about 2 mils to about 10 mils, and in one embodiment from about 4 mils or 4.5 mils to about 6 mils.

The substrate may comprise paper, polymer film, or a combination thereof. The need for proper substrate selection is particularly apparent in pressure sensitive or heat-activatable adhesive structures made with receptor laminates when said structures are larger than hand sheets, said hand sheets typically being of a size measuring about 8.5 inches by about 11 inches. Inappropriate substrate selection can result in buckling or wrinkling of such pressure sensitive or heat-activatable adhesive structures made with such receptor laminates. Paper substrates are useful because of the wide variety of applications in which they can be employed. Paper is also relatively inexpensive and has desirable properties such as antiblocking, antistatic, dimensional stability, and can potentially be recycled. Any type of paper having sufficient tensile strength to be handled in conventional paper coating and treating apparatus can be employed as the substrate material. Thus, any type of paper can be used depending upon the end use and particular personal preferences. Included among the types of paper which can be used are clay coated paper, glassine, polymer coated paper, and similar cellulose materials prepared by such processes as the soda, sulfite or sulfate (Kraft) processes, the neutral sulfide cooking process, alkali-chlorine processes, nitric acid processes, semi-chemical processes, etc. Although paper of any weight can be employed as a substrate material, paper having weights in the range of from about 30 pounds per ream to about 120 pounds per ream are useful, and papers having weights in the range of from about 60 pounds per ream to about 100 pounds per ream are presently preferred. The term "ream" as used herein equals 3000 square feet.

Alternatively, the substrate may be a polymer film, and examples of polymer films include polyolefin, polyester, nylon, etc., and combinations thereof. The polyolefin films may comprise polymer and copolymers of monoolefins having from 2 to about 12 carbon atoms, and in one embodiment from 2 to about 8 carbon atoms, and in one embodiment 2 to about 4 carbon atoms per molecule. Examples of such homopolymers include polyethylene, polypropylene, poly-1-butene, etc. The examples of copolymers within the above definition include copolymers of ethylene with from about 1% to about 10% by weight of propylene, copolymers of propylene with about 1% to about 10% by weight of ethylene or 1-butene, etc. Films prepared from blends of copolymers or blends of copolymers with homopolymers also are useful. The films may be extruded in mono or multilayers.

Another type of material which can be used as the substrate is a polycoated kraft liner which is comprised of a kraft liner that is coated on either one or both sides with a polymer coating. The polymer coating, which can be comprised of high, medium, or low density polyethylene, polypropylene or other similar polymers, can be extrusion coated on one or both sides of the substrate surface to add strength and/or dimensional stability to the liner. The weight of these types of liners can range from about 30 pounds per ream to about 100 pounds per ream, with about 40 pounds per ream to about 100 pounds per ream representing a typical range. In total, the final liner may be comprised of between about 10% and about 40% polymer and from about 60% to about 90% paper. For two sided coatings, the quantity of polymer is approximately evenly divided between the top and bottom surface of the paper. The polymer composition on the top surface may be the same or different than the composition on the bottom surface.

The pressure-sensitive or heat-activatable adhesive materials that can be used can be any pressure sensitive or heat-activatable adhesive known in the art. These include rubber based adhesives, acrylic adhesives, vinyl ether adhesives, silicone adhesives, and mixtures of two or more thereof. The adhesives can be in the form of hot melt, solution or emulsion adhesives. Included are the pressure sensitive or heat-activatable adhesive materials described in "Adhesion and Bonding", *Encyclopedia of Polymer Science and Engineering*, Vol. 1, pages 476–546, Interscience Publishers, 2nd Ed. 1985, the disclosure of which is hereby incorporated by reference. The pressure sensitive or heat-activatable adhesive materials that are useful may contain as a major constituent an adhesive polymer such as acrylic-type polymers; block copolymers; natural, reclaimed, or styrene-butadiene rubbers; tackified natural or synthetic rubbers; or random copolymers of ethylene and vinyl acetate, ethylene-vinyl-acrylic terpolymers, polyisobutylene, poly(vinyl ether), etc. The pressure sensitive or heat-activatable adhesive materials are typically characterized by glass transition temperatures in the range of about −70° C. to about 10° C.

Other materials in addition to the foregoing resins may be included in the pressure sensitive or heat-activatable adhesive materials. These include solid tackifying resins, liquid tackifiers (often referred to as plasticizers), antioxidants, fillers, pigments, waxes, etc. The adhesive materials may contain a blend of solid tackifying resins and liquid tackifying resins (or liquid plasticizers).

An example of a commercially available pressure sensitive adhesive that can be used is Aeroset 1460 which is a product of Ashland Chemical identified as a solvent acrylic adhesive.

An example of a commercially available heat-activatable adhesive that can be used in Elvax 3185 which is a product of DuPont identified as a heat seal adhesive.

The coat weight of the pressure sensitive or heat-activatable adhesive composition is generally in the range of about 10 gsm to about 50 gsm, and in one embodiment about 20 gsm to about 35 gsm.

The pressure sensitive or heat-activatable adhesive can be applied to either the receptor laminate (on either the second side of the core layer or on the skin layer adhered to the second side of the core layer) or to the cured release coating layer of the release coated substrate using known techniques. These include gravure, reverse gravure, offset gravure, roller coating, brushing, knife-over roll, metering rod, reverse roll coating, doctor knife, dipping, die coating, spraying, curtain coating, and the like. When the pressure sensitive adhesive is applied to the receptor laminate, the pressure sensitive receptor laminate structure is assembled by contacting the release coated substrate and the adhesive using known techniques, such as cold roll lamination. When the heat-activatable adhesive is applied to the receptor laminate, the heat-activatable receptor laminate structure is assembled by contacting the release coated substrate and the adhesive using known techniques, such as hot roll lamination. When the pressure sensitive adhesive is applied to the release coated substrate, the pressure sensitive receptor laminate structure is assembled by contacting the receptor laminate and the adhesive using known techniques, such as cold roll lamination. When the heat-activatable adhesive is applied to the release coated substrate, the heat-activatable receptor laminate structure is assembled by contacting the receptor laminate and the adhesive using known techniques, such as hot roll lamination. In the assembled pressure sensitive or heat-activatable receptor laminate structure, the pressure sensitive or heat-activatable adhesive is positioned between the receptor laminate and the cured release coating, and is preferentially adherent to the receptor laminate. The cured release coating is positioned between the pressure sensitive or heat-activatable adhesive and the substrate, and is preferentially adherent to the substrate. The pressure sensitive or heat-activatable receptor laminate may be used by pulling off the release coated substrate and discarding it. The exposed pressure sensitive or heat-activatable adhesive is pressed onto a surface where the receptor laminate is to be placed using pressure in the case of a pressure sensitive receptor laminate or heat and pressure in the case of the heat-activatable receptor laminate.

In one embodiment, the pressure sensitive or heat-activatable receptor laminate adhesive structure has a thickness in the range of about 5 mils to about 40 mils, and in one embodiment about 5 mils to about 25 mils, and in one embodiment about 8 mils to about 20 mils, and in one embodiment about 10 mils to about 15 mils, and in one embodiment about 11 mils to about 12.5 mils.

Process for Making the Imaged Receptor Laminate

The process for making the inventive imaged receptor laminate involves contacting the electrographic transfer sheet and the receptor laminate under appropriate conditions of temperature, pressure and contact time to bond them together. During this contacting step, the dielectric layer with the electrostatically formed and developed image thereon is pressed against the skin layer overlying the first side of the core layer of the receptor laminate. This contacting process can be accomplished in many ways known in the art such as passing the electrographic transfer sheet and the receptor laminate together through the heated nip rollers of a roll laminator, or placing the electrographic transfer sheet and the receptor laminate together on a heated platen in a vacuum draw down frame. The laminating temperature at the point of contact is generally in the range of about 40° C. to about 200° C., and in one embodiment about 65° C. to about 160° C. The pressure applied to the rolls utilized in a heated roll laminator is generally in the range of about 25 psig to about 125 psig, and in one embodiment about 70 psig to about 110 psig. The contacting time between the rolls utilized in a heated roll laminator is generally in the range of about 0.25 second to about 1 second, and in one embodiment about 0.25 second to about 0.4 second, and in one embodiment about 0.5 second to about 1 second.

Typically, the resulting toner bond quality, or "image receptivity," is evaluated by means of toner bond adhesion to the imaged receptor laminate and/or toner removal from the imaged receptor laminate. A technique for conducting toner bond quality evaluations is known to those skilled in the art and is conducted by means of a snap tape test in which 3M Scotch Tape No. 610, or similar tape, is firmly applied to the image and then removed with a rapid motion. The quality of the toner bond is then judged by the difficulty of removal and the amount of toner removed with the tape from the receptor laminate. In actual practice, it has been found that the preceding test method is not fully predictive of actual imaged receptor laminate performance as it relates to more common end-uses of said imaged receptor laminate. A more predictive method of evaluation has been employed using a 1 inch×12 inch strip of overlaminate protective film in place of the 3M Scotch Tape No. 610. This method is particularly useful for evaluating toner bond quality for intended end-use applications requiring the use of an overlaminate protective film. This method requires application of the strip of overiaminate protective film to the imaged receptor laminate in a controlled manner, aging of the adhesive bond between the strip of overlaminate protective film and the imaged receptor laminate for a specific dwell period, and removal of the strip of overlaminate protective film in a predictive, quantifiable, controlled manner. The force required to remove the strip of overlaminate protective film from the imaged receptor laminate is recorded. The amount of toner removed from the imaged receptor laminate by the strip of overlaminate protective film is recorded as a percentage of removal.

Overlaminate Protective Layer for the Imaged Receptor Laminate

In one embodiment, an overlaminate protective layer overlies the electrostatically formed and developed image that is adhered to the receptor laminate. This provides the imaged receptor laminate with enhanced durability and abrasion resistance. In embodiments wherein the dielectric layer remains adhered to the imaged receptor laminate, the overlaminate protective layer is adhered to the dielectric layer. In embodiments wherein the dielectric layer is removed, the overlaminate protective layer is adhered to the formed and developed image; in embodiments wherein the image does not cover the entire surface of the thermoplastic skin layer to which it is adhered, the overlaminate protective layer adheres to the image in the covered portions and the skin layer in the non-covered portions.

The overlaminate protective layer can be comprised of a thermoplastic film and a pressure sensitive or heat-activatable adhesive adhered to one side of the film. The overlaminate protective layer is depicted, for example, as item 45 in FIG. 9. The overlaminate protective layer is sufficiently clear to permit visibility of the electrostatically formed and developed image through it.

The thermoplastic film of the overlaminate protective layer may have a single layer or a multilayered structure. It can be comprised of a thermoplastic polymer that can be: a polyolefin; an ionomer resin derived from sodium, lithium or zinc and ethylene/methacrylic acid copolymers; an ethylene acrylic or methacrylic acid copolymer; an ethylene-vinylacetate terpolymer wherein the termonomer is acrylic acid, methyl acrylate or maleic anhydride; a polymethylmethacrylate; or a polyester.

The polyolefins that can be useful include polyethylene, polypropylene or polybutylene or copolymers of ethylene, propylene or butylene with an alpha olefin. The alpha olefin, is selected from those alpha olefins containing from 2 to about 18 carbon atoms, and in one embodiment 2 to about 12 carbon atoms, and in one embodiment 2 to about 8 carbon atoms including ethylene, butylene, hexene and octene. Medium density polyethylenes and the linear medium density polyethylenes are useful. Useful polyolefins include those prepared using a Ziegler-Natta catalyst or a metallocene catalyst. An example of the useful polyolefin is available from Dow Chemical under the trade designation Affinity 103OHF, which is identified as a metallocene catalyst catalyzed octene-ethylene copolymer.

The ionomer resins available from DuPont under the tradename Surlyn can be used. These resins are identified as being derived from sodium, lithium or zinc and copolymers of ethylene and methacrylic acid. Included in this group are: Surlyn 1601, which is a sodium containing ionomer; Surlyn 1605, which is a sodium containing ionomer; Surlyn 1650, which is a zinc containing ionomer; Surlyn 1652, which is a zinc containing ionomer; Surlyn 1702, which is a zinc containing ionomer; Suryin 1705–1, which is a zinc containing ionomer; Surlyn 1707, which is a sodium containing ionomer; Surlyn 1802, which is a sodium containing ionomer; Surlyn 1855, which is a zinc containing ionomer; Surlyn 1857, which is a zinc containing ionomer; Surlyn 1901, which is a sodium containing ionomer; Surlyn AD-8546, which is a lithium containing ionomer; Surlyn AD-8547, which is a zinc containing ionomer; Surlyn AD-8548, which is a sodium containing ionomer; Surlyn 7930, which is a lithium containing ionomer; Surlyn 7940, which is a lithium containing ionomer; Surlyn 8020, which is a sodium containing ionomer; Surlyn 8140, which is a sodium containing ionomer; Surlyn 8528, which is a sodium containing ionomer; Surlyn 8550, which is a sodium containing ionomer; Surlyn 8660, which is a sodium containing ionomer; Surlyn 8920, which is a sodium containing ionomer; Surlyn 8940, which is a sodium containing ionomer; Surlyn 9120, which is a zinc containing ionomer; Surlyn 9650, which is a zinc containing ionomer; Surlyn 9730, which is a zinc containing ionomer; Surlyn 9910, which is a zinc containing ionomer; Surlyn 9950, which is a zinc containing ionomers; and Surlyn 9970, which is a zinc containing ionomer.

The ethylene acrylic or methacrylic acid copolymers that can be used include those available from DuPont under the tradename Nucrel. These include Nucrel 0407, which has a methacrylic acid content of 4% by weight and a melting point of 109° C., and Nucrel 0910, which has a methacrylic acid content of 8.7% by weight and a melting point of 100C.

The ethylene/acrylic acid copolymers available from Dow Chemical under the tradename Primacor are also useful. These include Primacor 1430, which has an acrylic acid monomer content of 9.5% by weight and melting point of 97° C.

The concentration of the thermoplastic polymer in the thermoplastic film of the overlaminate protective film layer is generally at least about 30% weight, and in one embodiment about 30% to about 99.5% weight, and in one embodiment about 75% to about 99.5% by weight.

The thermoplastic film of the overlaminate protective layer may, and preferably does, contain a UV light absorber or other light stabilizer. These include the UV light absorbers and light stabilizers described above as being used in the core layer and the skin layers of the receptor laminate. Among the UV light absorbers that are useful are the hindered amine absorbers available from Ciba-Geigy under the trade designation Tinuvin, especially those available under the designations Tinuvin 234, Tinuvin 326, Tinuvin 327 and Tinuvin 328. The light stabilizers that can be used include the hindered amine light stabilizers available from Ciba-Geigy under the trade designations Tinuvin 111, Tinuvin 123, Tinuvin 622, Tinuvin 770 and Tinuvin 783. Also useful light stabilizers are the hindered amine light stabilizers available from Ciba-Geigy under the trade designation Chimassorb, especially Chimassorb 119 and Chimassorb 944. The concentration of the UV light absorber and/or light stabilizer in the thermoplastic film composition is in the range of up to about 2.5% by weight, and in one embodiment about 0.05% to about 1% by weight.

The thermoplastic film of the overlaminate protective layer may contain an antioxidant. Any antioxidant useful in making thermoplastic films can be used. These include the hindered phenols and the organo phosphites. Examples include those available from Ciba-Geigy under the trade designations Irganox 1010, Irganox 1076 or Irgafos 168. The concentration of the antioxidant in the thermoplastic film composition is in the range of up to about 2.5% by weight, and in one embodiment about 0.05% to about 1% by weight.

The thermoplastic film of the overlaminate protective layer may contain a metal deactivator. Any metal deactivator useful in making thermoplastic films can be used. These include the hindered phenol metal deactivators. Examples include those available from Ciba-Geigy under the trade designation Irganox 1024. The concentration of the metal deactivator in the thermoplastic film composition is in the range of up to about 1% by weight, and in one embodiment about 0.2% to about 0.5% by weight.

The thickness of the thermoplastic film of the overlaminate protective layer is generally in the range of about 0.5 to about 5 mils, and in one embodiment about 1 to about 3 mils.

The pressure sensitive or heat-activatable adhesive that is adhered to the thermoplastic film of the overlaminate protective layer may be any of the pressure sensitive or heat-activatable adhesives described above under the subtitle "Pressure Sensitive or Heat-Activatable Adhesive Structure." An especially useful pressure sensitive adhesive is Aeroset 1460. An especially useful heat-activatable adhesive is Elvax 3185. The pressure sensitive or heat-activatable adhesive may be blended with one or more of the UV light absorbers, light stabilizers, antioxidants and/or metal deactivators described above as being useful in making the thermoplastic film of the overlaminate protective film layer. These additive materials are typically added to the pressure sensitive or heat-activatable adhesive composition at concentrations of up to about 2.5% by weight for each of the additive materials based on the overall weight of the pressure sensitive or heat-activatable adhesive composition, and in one embodiment about 0.05 to about 1% by weight.

The thickness of the pressure sensitive or heat-activatable adhesive of the overlaminate protective layer is generally in the range of about 0.25 mil to about 2 mils, and in one embodiment about 0.5 mil to about 1 mil. In one embodiment, the coat weight of this pressure sensitive or heat-activatable adhesive is generally in the range of about 10 gsm to about 50 gsm, and in one embodiment about 20 gsm to about 35 gsm.

The overlaminate protective layer is adhered to the imaged receptor laminate by contacting the film layer and the laminate using known techniques. The pressure sensitive or heat-activatable adhesive of the overlaminate protective layer contacts the imaged receptor laminate and adheres the film layer to the laminate.

Prior to adhering the overlaminate protective layer to the imaged receptor laminate, the overlaminate protective layer may be provided with a release liner overlying its pressure sensitive adhesive layer. The use of the release liner facilitates the handling of the overlaminate protective layer. During the step of adhering the overlaminate protective layer to the laminate, the release liner is stripped from the overlaminate protective layer, thus exposing the pressure sensitive adhesive. Any of the release liners described above under the subtitle "Pressure Sensitive or Heat-Activatable Adhesive Structure" can be used.

Alternatively, the first surface of the overlaminate protective layer can be release coated to permit a self-wound roll structure, wherein the pressure sensitive or heat-activatable adhesive coated second surface of the overlaminate protective layer is wound in contact with the release coated first surface of said overlaminate protective layer. The release coating composition can be any release coating composition known in the art. Silicone release coating compositions are preferred, and any of the silicone release coating compositions which are known in the art can be used. The major component of the silicone release coating is a polyorganosiloxane and more often, polydimethylsiloxane. The silicone release coating compositions used in this invention may be room temperature cured, thermally cured, or radiation cured. Generally, the room temperature and thermally curable compositions comprise at least one polyorganosiloxane and at least one catalyst (of curing agent) for such polyorganosiloxane(s). Such compositions may also contain at least one cure accelerator and/or adhesion promoter (sometimes referred to as an anchorage additive). As is known in the art, some materials have the capability of performing both functions, i.e., the capability of acting as a cure accelerator to increase the rate, reduce the curing temperature, etc., and also as an adhesion promotor to improve bonding of the silicone composition to the substrate. The use of such dual function additives where appropriate is within the purview of the invention.

The release coating compositions are applied to the overlaminate protective layer using known techniques. These include gravure, reverse gravure, offset gravure, roller coating, brushing , knife-over roll, metering rod, reverse roll coating, doctor knife, dipping, die coating, spraying curtain coating, and the like. The coat weight is in the range of about 0.1 grams per square meter (gsm) to about 10 gsm or more, and in one embodiment about 0.3 gsm to about 2 gsm. In one embodiment, the thickness or caliper of the resulting release-coated substrate may range from 5 about 0.5 mil to about 10 mils, and in one embodiment from about 1 mil to about 6 mils.

Figure 1:
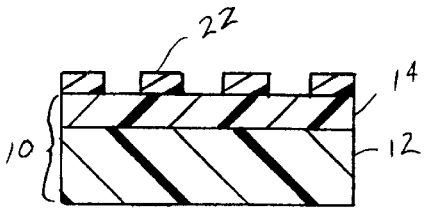
FIG. 1 is a schematic illustration of the side view of an imaged receptor laminate embodying the present invention in a particular form. The receptor laminate comprises a thermoplastic core layer, and a thermoplastic skin layer overlying one side of the core layer. An electrostatically formed and developed image is adhered to the skin layer.

Referring to FIG. 1, the imaged receptor laminate disclosed therein is comprised of a receptor laminate 10 and an electrostatically formed and developed image 22 adhered to such laminate. The receptor laminate 10 has a thermoplastic core layer 12 and a thermoplastic skin layer 14 overlying and adhered to the core layer 12. The image 22 is adhered to the skin layer 14. The thickness of the receptor laminate 10 is in the range of about 1 mil to about 10 mils, and in one embodiment about 2 mils to about 5 mils. The thickness of the core layer 12 ranges from about 10% to about 90% of the overall thickness of the receptor laminate 10, and the thickness of the skin layer 14 makes up the difference.

Figure 2:
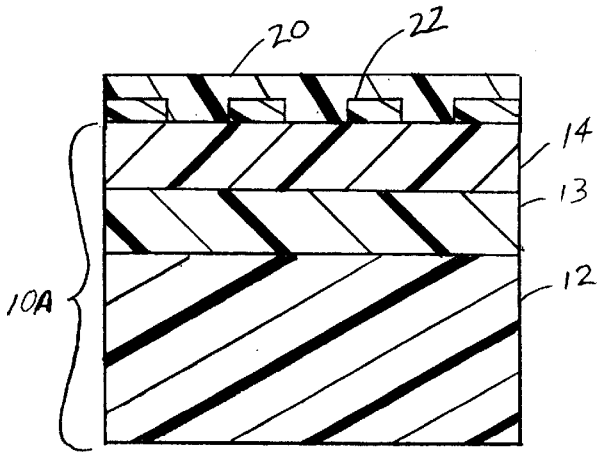
FIG. 2 is a schematic illustration of the side view of an imaged receptor laminate embodying the present invention in another particular form. The receptor laminate includes a thermoplastic core layer, a tie layer of an adhesive resin overlying one side of the core layer, and a thermoplastic skin layer overlying the tie layer. An electrostatically formed and developed image is adhered to the skin layer. A dielectric layer overlies the image and the skin layer.

Referring to FIG. 2, the imaged receptor laminate disclosed therein is comprised of receptor laminate 10A, an electrostatically formed and developed image 22 adhered to such laminate, and a dielectric layer 20 overlying said image 22 and said laminate. The laminate 10A has a core layer 12, a tie layer 13 overlying one side of the core layer, and a skin layer 14 overlying the tie layer. The receptor laminate 10A has an overall thickness in the range of about 1 mil to about 25 mils, and in one embodiment about 2 mils to about 20 mils, and in one embodiment about 2 mils to about 5 mils. The thickness of the tie layer 13 is from about 5% to about 30%, and in one embodiment about 10% to about 20% of the overall thickness of the receptor laminate 10A. The skin layer 14 has a thickness of about 5% to about 30%, and in one embodiment about 10% to about 20% of the overall thickness of the receptor laminate 10A.

Figure 3:
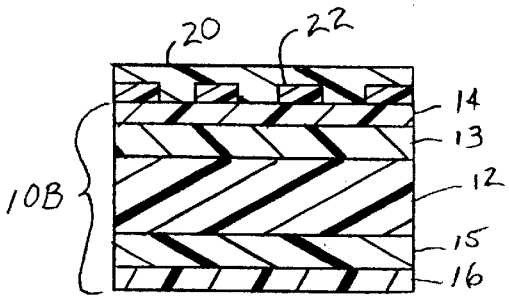
FIG. 3 is a schematic illustration of the side view of an imaged receptor laminate embodying the present invention in another particular form. The receptor laminate includes a thermoplastic core layer, tie layers of an adhesive resin overlying each side of the core layer, and thermoplastic skin layers overlying each of the tie layers. An electrostatically formed and developed image is adhered to one of the skin layers. A dielectric layer overlies the image and the skin layer to which the image is adhered.

Referring to FIG. 3, the imaged receptor laminate disclosed therein is comprised of receptor laminate 10B, an electrostatically formed and developed image 22 adhered to such laminate, and a dielectric layer 20 overlying said image 22 and said laminate. The receptor laminate 10B has a thermoplastic core layer 12, tie layers 13 and 15 overlying each side of the core layer, and thermoplastic skin layers 14 and 16 overlying the tie layers 13 and 15, respectively. The overall thickness of the receptor laminate 10B is in the range of about 1 mil to about 25 mils, and in one embodiment about 2 mils to about 20 mils, and in one embodiment about 2 mils to about 5 mils. The combined thickness of the skin layers 14 and 16 is from about 5% to about 30%, and in one embodiment about 10% to about 20% of the overall thickness of the laminate 10B. The skin layers 14 and 16 can have the same composition and/or dimensions, or such composition and/or dimensions can be different. The combined thickness of the tie layers 13 and 15 is from about 5% to about 30%, and in one embodiment about 10% to about 20% of the overall thickness of the receptor laminate 10B. The compositions and/or dimensions of the tie layers 13 and 15 can be the same or they can be different.

Figure 4:
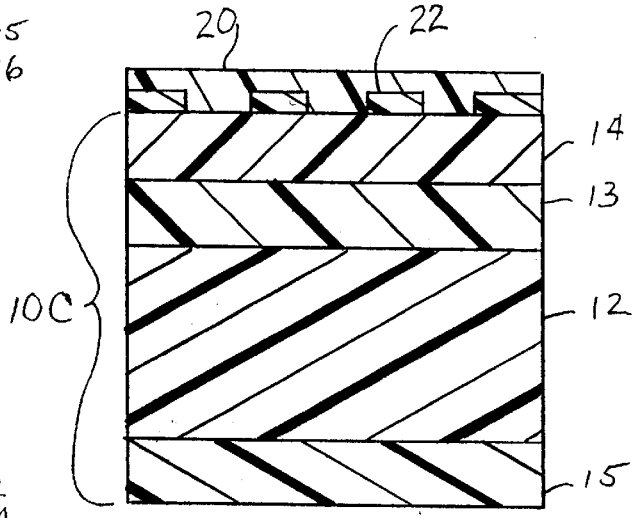
FIG. 4 is a schematic illustration of the side view of an imaged receptor laminate embodying the present invention in another particular form. The receptor laminate includes a thermoplastic core layer, tie layers of an adhesive resin overlying each side of the core layer, and a thermoplastic skin layer overlying one of the tie layers. An electrostatically formed and developed image is adhered to the skin layer. A dielectric layer overlies the image and the skin layer.

Referring to FIG. 4, the imaged receptor laminate disclosed therein is identical to the imaged receptor laminate disclosed in FIG. 2 with the exception that the imaged receptor laminate 10C disclosed in FIG. 4 includes a tie layer 15 of an adhesive resin overlying one side of the core layer 12. The thickness of the tie layer 15 is from about 5% to about 30%, and in one embodiment about 10% to about 20% of the overall thickness of the receptor laminate 10C.

Figure 5:
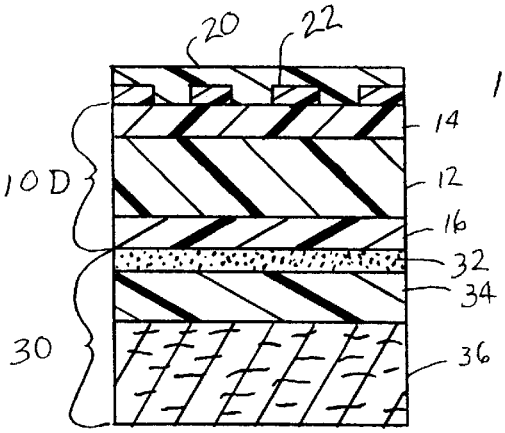
FIG. 5 is a schematic illustration of the side view of an imaged receptor laminate embodying the present invention in another particular form. The laminate includes a thermoplastic core layer having a first side and a second side, a first thermoplastic skin layer overlying the first side of the core layer, and a second thermoplastic skin layer overlying the second side of the core layer. An electrostatically formed and developed image is adhered to the first skin layer. A dielectric layer overlies the image and the first skin layer. A pressure sensitive or heat-activatable adhesive is adhered to the second skin layer. A layer of a release coating overlies the pressure or heat-activatable sensitive adhesive. A substrate overlies the release coating layer.

Referring to FIG. 5, the imaged receptor laminate disclosed therein includes a receptor laminate 10D and a pressure sensitive or heat-activatable adhesive composite 30. The receptor laminate 10D has a thermoplastic core layer 12, which has a first side and a second side, and a first thermoplastic skin layer 14 overlying the first side of the core layer. An electrostatically formed and developed image 22 is adhered to the first skin layer 14, and a dielectric layer 20 overlies image 22 and skin layer 14. The laminate 10D also has a second thermoplastic skin layer 16 overlying the second side of the core layer 12. Pressure sensitive or heat-activatable adhesive composite 30 overlies the skin layer 16. The adhesive composite 30 has a layer of a pressure sensitive or heat-activatable adhesive 32 adhered to the skin layer 16, a layer of a release coating 34 overlying the pressure sensitive or heat-activatable adhesive 32, and a substrate 36 (e.g., paper, polymer film, etc.) overlying the release coating layer 34.

Figure 6:
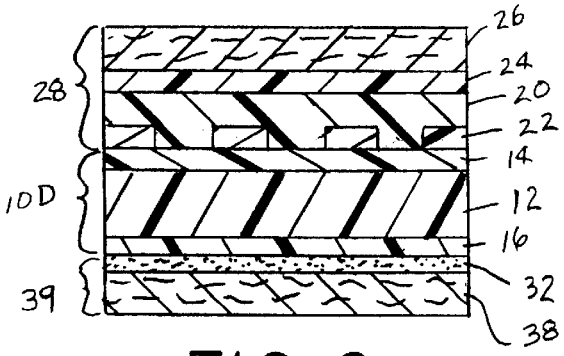
FIG. 6 is a schematic illustration of the side view of an imaged receptor laminate embodying the present invention in another particular form. The receptor laminate includes a thermoplastic core layer having a first side and a second side, a first thermoplastic skin layer overlying the first side of the core layer, and a second thermoplastic skin layer overlying the second side of the core layer. An electrostatically formed and developed image is adhered to the first skin layer. A dielectric layer overlies the image and the first skin layer. A conductive layer overlies the dielectric layer. A carrier sheet overlies the conductive layer. A pressure sensitive or heat-activatable adhesive is adhered to the second skin layer. A release coated substrate overlies the pressure sensitive or heat-activatable adhesive.

Referring to FIG. 6, the imaged receptor laminate disclosed therein includes a receptor laminate 10D, an electrographic transfer sheet 28 overlying and adhered to one side of the receptor laminate 10D, and a pressure sensitive or heat-activatable adhesive composite 39 overlying and adhered to the other side of laminate 10D. The laminate 10D has a thermoplastic core layer 12, which has a first side and a second side, a thermoplastic skin layer 14 overlying the first side of the core layer 12, and a thermoplastic skin layer 16 overlying the second side of core layer 12. The electrographic transfer sheet 28 includes an electrostatically formed and developed image 22, a dielectric layer 20 overlying image 22 and skin layer 14, a conductive layer 24 overlying the dielectric layer 20, and a carrier sheet 26 overlying the conductive layer 24. Image 22 is adhered to skin layer 14. The adhesive composite 39 includes a pressure sensitive or heat-activatable adhesive 32 adhered to skin layer 16, and a release coated substrate 38 overlying the pressure sensitive or heat-activatable adhesive 32.

Figure 7:
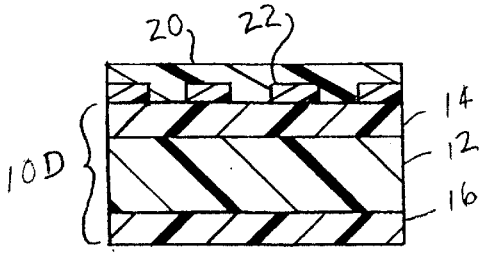
FIG. 7 is a schematic illustration of the side view of an imaged receptor laminate embodying the present invention in another particular form. The receptor laminate comprises a thermoplastic core layer, and thermoplastic skin layers overlying each side of the core layer. An electrostatically formed and developed image is adhered to one of the skin layers. A dielectric layer overlies the image and the skin layer to which the image is adhered.

Referring to FIG. 7, the imaged receptor laminate disclosed therein is comprised of receptor laminate 10D, which has a core layer 12 and thermoplastic skin layers 14 and 16 adhered to the sides of the core layer 12. The imaged receptor laminate includes electrostatically formed and developed image 22, which is adhered to skin layer 14, and dielectric layer 20, which overlies image 22 and skin layer 14.

Figure 8:
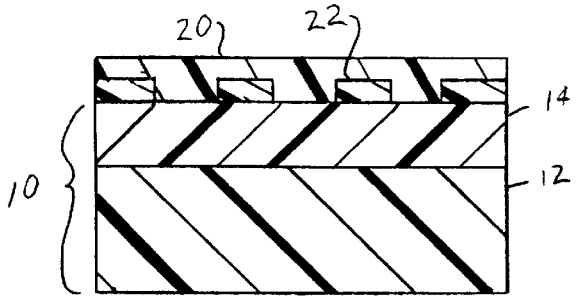
FIG. 8 is a schematic illustration of the side view of an imaged receptor laminate embodying the present invention in another particular form The receptor laminate includes a thermoplastic core layer, and a thermoplastic skin layer overlying the core layer. An electrostatically formed and developed image is adhered to the skin layer. A dielectric layer overlies the image and the skin layer.

Referring to FIG. 8, the imaged receptor laminate disclosed therein is comprised of receptor laminate 10, electrostatically formed and developed image 22 adhered to laminate 10, and a dielectric layer 20, which overlies image 22 and laminate 10. The laminate 10 has a core layer 12 and skin layer 14 overlying one side of the core layer. The image 22 is adhered to skin layer 14.

Figure 9:
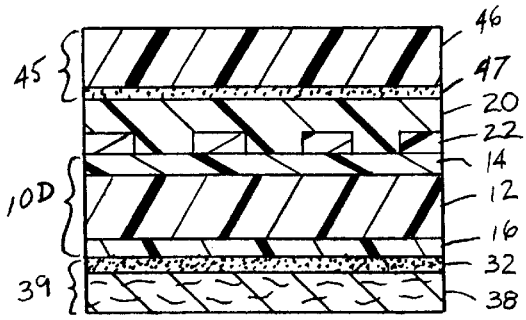
FIG. 9 is a schematic illustration of the side view of an imaged receptor laminate embodying the present invention in another particular form.

Referring to FIG. 9, the imaged receptor laminate disclosed therein includes a receptor laminate 10D, an electrostatically formed and developed image 22 overlying one side of the receptor laminate 10D, a dielectric layer 20 overlying the image 22 and the receptor laminate 10D, an overlaminate protective layer 45 overlying the dielectric layer 20, and a pressure sensitive or heat-activatable adhesive composite 39 overlying the other side of laminate 10D. The laminate 10D has a thermoplastic core layer 12, which has a first side and a second side, a thermoplastic skin layer 14 overlying the first side of the core layer 12, and a thermoplastic skin layer 16 overlying the second side of core layer 12. The image 22 is adhered to skin layer 14. The overlaminate protective layer 45 includes thermoplastic film 46 and pressure sensitive or heat-activatable adhesive 47. Pressure sensitive or heat-activatable adhesive 47 is positioned between thermoplastic film 46 and dielectric layer 20 and adheres film 46 to dielectric layer 20. Adhesive composite 39 includes pressure sensitive or heat-activatable adhesive 32 which is adhered to skin layer 16, and release coated substrate 38 which is adhered to pressure sensitive or heat-activatable adhesive 32.

An extrusion process for making the receptor laminate 10D is disclosed in FIG. 10. The apparatus used in this process includes extruders 100, 102 and 104, screen changers 106, 108 and 110, adapter block 112, cast extrusion die 114, air knife 118, casting roll 120, chill roll 122, and nip rolls 124. The polymeric material for forming skin layer 14 is extruded from extruder 100 through screen changer 106 to adapter block 112 and cast extrusion die 114. The polymeric material for forming core layer 12 is extruded from extruder 102 through screen changer 108 to adapter block 112 and cast extrusion die 114. The polymeric material for forming skin layer 16 is extruded from extruder 104 through screen changer 110 to adapter block 112 and cast extrusion die 114. In extrusion die 114 the polymeric materials are combined to form the receptor laminate 10D. The receptor laminate 10D is advanced from extrusion die 114, past air knife 118, under casting roll 120, over chill roll 122, through nip rolls 124 to take-up roll 126 where it is wound to provide the final receptor laminate 10D in roll form. Those skilled in the art will recognize that the process illustrated in FIG. 10 can be modified to provide for the co-extrusion of additional film layers such as the tie layers 13 and 15 illustrated in FIGS. 3 or 4 by providing, for example, additional extruders and corresponding screen changers and the like.

In one embodiment, the nip rolls 124 in FIG. 10 are replaced by a pair of annealing rolls (not shown in the drawing). The receptor laminate is advanced over a first annealing roll operating at a temperature in the range of about 38° C. to about 72° C., and in one embodiment about 60° C., and then over a second annealing roll operating at a temperature of about 60° C. to about 121° C., and in one embodiment about 74° C. The laminate is then advanced to the take-up roll 126 as indicated in FIG. 10.

An illustrated embodiment of the process for making the imaged receptor laminate of the invention is depicted in FIG. 11. The process includes the use of imaged electrographic transfer sheet 28, which is provided in roll form, idler roll 202, wrap around idler roll 204 and heated nip rolls 206 and 208. The imaged electrographic transfer sheet 28 is unwound and advanced under idler roll 202, over wrap around idler roll 204 and through heated nip rolls 206 and 208. At the same time, receptor laminate 10D is advanced from right to left through heated nip rollers 206 and 208 in contact with the electrographic transfer sheet 28. Contact is made between the dielectric layer 20 and image 22 of the electrographic transfer sheet 28, and the skin layer 14 of the receptor laminate 10D. The pressure and heat applied to the electrographic transfer sheet 28 and the receptor laminate 10D from nip rollers 206 and 208 are sufficient to adhere the two materials together to form the desired imaged receptor laminate 11.

The following examples are provided to further disclose the invention. In these examples as well as throughout the specification and in the claims, unless otherwise indicated, all parts and percentages are by weight, and all temperatures are in degrees Celsius.

EXAMPLE 1

The receptor laminate 10D comprised of core layer 12 with skin layers 14 and 16 on each side is coextruded. The core layer has the following composition:

60% Polypropylene 5A97

10% Elvax 3190 LG

3% Ampacet 10561 UV Stabilizer Concentrate
- 20% UV Stabilizer
- 80% low density polyethylene carrier resin 27% Schulman PolyBatch White P8555 SD
- 50% $TiO_2$
- 50% Polypropylene carrier resin Each of the skin layers has the following composition:

3% Ampacet 10561

10% Elvax CE 9619-1
- 7% Amide slip additive
- 20% Silica antiblock agent
- 73% Elvax 3170

87% Elvax 3190 LG

A pressure sensitive adhesive composite is adhered to skin layer 16. An imaged electrographic transfer sheet provided by 3M under the trade designation 3M Image Transfer Media is adhered to the skin layer 14.

EXAMPLE 2

Part A

The receptor laminate 10D comprised of core layer 12 with skin layers 14 and 16 on each side is coextruded. The core layer 12 has the following composition:

48% Polypropylene 5A97

15% Elvax 3190 LG

5% Ampacet 10561

30% Schulman PolyBatch White P8555 SD

2% Schulman 8588 NAP Concentrate

Skin layer 14 has the following composition:

5% Ampacet 10561

95% Elvax 3190 LG

Skin layer 16 has the following composition:

5% Ampacet 10561

15% CABL 4040

40% Polypropylene 5A97

40% Ultrathene UE 631-04

A pressure sensitive adhesive composite is adhered to skin layer 16. An electrographic transfer sheet, which is prepared using Rexam Graphics Dry Transfer Paper comprised of a conductive paper layer and a dielectric layer and Xerox Turbo toner ink, is adhered to the skin layer 14 using an GBC Pro-Tech Orca III laminator operated at a speed of 1.5 fpm, an air pressure of 85 psig, an upper roll temperature of 250° F. (121° C.) and a lower roll temperature of 180° F. (82° C.). The resulting product is the desired pressure sensitive adhesive structure having a toner layer adhered to skin layer 14 and a dielectric layer overlying the toner layer.

Part B

The pressure sensitive adhesive structure disclosed in Part A is tested for toner bond strength and toner removal. The conductive paper layer is peeled off leaving the dielectric layer exposed and the toner layer underlying the dielectric layer. A 1 inch×12 inch strip of clear vinyl overlaminate protective film having an acrylic solvent adhesive applied to it is adhered to the dielectric layer of the imaged receptor laminate and allowed to age at room temperature for 24 hours. An Instron tensile tester is used to remove the strip of clear vinyl overlaminate protective film and the force required to remove said film is measured. The amount of toner removed from the imaged receptor laminate is also measured. This procedure is repeated for comparative purposes using, in one instance, a dispersion cast monolayer vinyl film in place of the receptor laminate 10D and, in the other instance, a calendered monolayer vinyl film in place of the receptor laminate 10D. The results are as follows:

| | Average Bond Strength (lbs.) | Toner Removal (%) |
|---|---|---|
| Part A Laminate | 3.7 | 0 |
| Dispersion Cast Vinyl Film | 2.7 | 15 |
| Calendered Vinyl Film | 2.7 | 10 |

EXAMPLE 3

Six multilayered receptor laminates 10, which are each comprised of a core layer 12 and a skin layer 14, are coextruded. The core layer for each laminate has the following composition.

24% Ampacet 110233

61% Dow Affinity 1030-HF

15% Lyondell M6060

The skin layers 14 have the following compositions:

(a) 95% EMA 2205
5% Ampacet 10561

(b) 95% Primacor 1430
5% Ampacet 10561

(c) 95% Ultrathene UE 631-04
5% Ampacet 10561

(d) 95% Surlyn 1605
5% Ampacet 10561

(e) 95% Elvax 3175
5% Ampacet 10561

(f) 75% Elvax 3175
20% Elvax 3185
5% Ampacet 10561

The overall thickness of each of the laminates is 3 mils. The skin layer has a thickness of 0.3 mils. A pressure sensitive adhesive composite is adhered to the side of the core layers 12 opposite the side to which the skin layers 14 are adhered. An imaged electrographic transfer sheet provided by 3M under the trade designation 3M Image Transfer Media is adhered to each of the skin layers 14.

EXAMPLE 4

The receptor laminate 10C comprised of core layer 12, tie layer 13 overlying one side of core layer 12, tie layer 15 overlying the other side of core layer 12, and skin layer 14 overlying tie layer 13 is coextruded. The core layer 12 has the following composition:

60% Polypropylene 5A97

10% Elvax 3190 LG

3% Ampacet 10561

27% Schulman PolyBatch White P8555 SD

The tie layer 13 has the following composition:

5% Ampacet 10561

95% Elvax 3190

The skin layer 14 has the following composition:

95% Surlyn 1605

5% Ampacet 10561

The tie layer 15 has the following composition:

94% Elvax 3190 LG

3% Ampacet 10561

3% Elvax CE 9619-1

A pressure sensitive adhesive composite is adhered to the tie layer 15. An imaged electrographic transfer sheet provided by 3M under the trade designation 3M Image Transfer Media is adhered to the skin layer 14.

EXAMPLE 5

The receptor laminate 10D comprised of core layer 12 with skin layers 14 and 16 on each side is coextruded. The core layer 12 has the following composition:

48% Polypropylene 5A97

15% Elvax 3190 LG

5% Ampacet 10561

30% Schulman PolyBatch White P8555 SD

2% Schulman 8588 NAP Concentrate

Skin layer 14 has the following composition:

5% Ampacet 10561

95% Elvax 3190 LG

Skin layer 16 has the following composition:

5% Ampacet 10561

15% CABL 4040

40% Polypropylene 5A97

40% Ultrathene UE 631-04

A pressure sensitive adhesive composite is adhered to skin layer 16. An electrographic transfer sheet, which is prepared using Rexam Graphics Dry Transfer Paper comprised of a conductive paper layer and a dielectric layer and Xerox Turbo toner ink, is adhered to the skin layer 14 using an GBC Pro-Tech Orca III laminator operated at a speed of 1.5 fpm, an air pressure of 85 psig, an upper roll temperature of 250° F. (121° C.) and a lower roll temperature of 180° F. (82° C.). The conductive paper layer is peeled off leaving the dielectric layer exposed and the toner layer underlying the dielectric layer. The resulting product is a pressure sensitive adhesive structure having a toner layer adhered to skin layer 14 and a dielectric layer overlying the toner layer. An overlaminate protective film layer comprised of a thermoplastic film and a pressure sensitive adhesive layer is adhered to the surface of the dielectric layer. The thermoplastic film of the overlaminate protective film layer has a thickness of 1 mil and the following composition:

90% Surlyn 1605

10% Ampacet 10561

The adhesive of the overlaminate protective film layer is Aeroset 1460, the thickness of this adhesive layer being 0.5 mil.

The imaged receptor laminate of the invention may be used for graphic applications ranging from signs, decals, and the like, for traffic signs, recreational vehicles, boats, trucks, and auto license plates, as well as for architectural and promotional graphics. The imaged receptor laminates may be used as printed or imaged transparencies that can be laminated over other imaged laminates or films for creative sign applications (e.g., reflective signage, window graphics, etc.).

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An imaged receptor laminate, comprising:

a thermoplastic core layer having a first side and a second side;

a thermoplastic skin layer overlying said first side of said core layer, said skin layer comprising a major amount of a thermoplastic copolymer or terpolymer derived from ethylene or propylene and a functional monomer selected from the group consisting of alkyl acrylate, acrylic acid, alkyl acrylic acid, vinyl acetate and combinations of two or more thereof, wherein said skin layer is characterized by the absence of an acid- or acid/acrylate-modified ethylene vinyl acetate resin, said skin layer having a melting point in the range of about 50° C. to about 120° C., said core layer having a melting point that is higher than the melting point of said skin layer;

an electrostatically formed and developed image adhered to said skin layer; and a dielectric layer overlying said image and said skin layer.

2. The laminate of claim 1 wherein a conductive carrier sheet overlies said dielectric layer.

3. The laminate of claim 1 wherein an overlaminate protective layer overlies said image and said skin layer.

4. The laminate of claim 1 wherein an overlaminate protective layer overlies said dielectric layer.

5. The laminate of claim 1 wherein another skin layer overlies said second side of said core layer, said another skin layer comprising a major amount of a thermoplastic copolymer or terpolymer derived from ethylene or propylene and a functional monomer selected from the group consisting of alkyl acrylate, acrylic acid, alkyl acrylic acid, vinyl acetate and combinations of two or more thereof, said another skin layer having a melting point in the range of about 50° C. to about 120° C., said core layer having a melting point that is higher than the melting point of said another skin layer.

6. The laminate of claim 5 wherein said skin layer and said another skin layer have the same or substantially the same composition.

7. The laminate of claim 1 wherein a tie layer of an adhesive resin is positioned between said core layer and said skin layer.

8. The laminate of claim 1 wherein said core layer and said skin layer comprise a coextrudate.

9. The laminate of claim 5 wherein a tie layer of an adhesive resin is positioned between said core layer and said another skin layer.

10. The laminate of claim 5 wherein said core layer, said skin layer and said another skin layer comprise a coextrudate.

11. The laminate of claim 5 wherein a tie layer of an adhesive resin is positioned between said core layer and said skin layer, and another tie layer of an adhesive resin is positioned between said core layer and said another skin layer.

12. The laminate of claim 1 wherein a pressure sensitive or heat-activatable adhesive is adhered to said second side of said core layer, and a release coated substrate is adhered to said pressure sensitive or heat-activatable adhesive, said release coated substrate comprising a substrate and a layer of a cured release coating composition adhered to one side of said substrate, said release coating composition being positioned between said pressure sensitive or heat-activatable adhesive and said second substrate.

13. The laminate of claim 5 wherein a pressure sensitive or heat-activatable adhesive is adhered to said another skin layer, and a release coated substrate is adhered to said pressure sensitive or heat-activatable adhesive, said release coated substrate comprising a substrate and a layer of a cured release coating composition adhered to one side of said substrate, said release coating composition being positioned between said pressure sensitive or heat-activatable adhesive and said substrate.

14. The laminate of claim 1 wherein in said core layer comprises at least one thermoplastic polymer selected from the group consisting of polyethylene, polypropylene, polybutylene, polyethylene methyl acrylic acid, polyethylene ethyl acrylate, metallocene-catalyst-catalyzed polyolefins, polystyrene, polyethylene methyl acrylate, acrylonitrile, butadiene styrene polymer, polyethylene vinyl alcohol, polyethylene vinyl acetate, nylon, polyurethane, polycarbonate, styrene maleic anhydride polymer, styrene acrylonitrile polymer, ionomers based on sodium or zinc salts of ethylene/methacrylic acid, polymethyl methacrylates, polybutylene terephthalate, polyethylene terephthalate, thermoplastic polyesters, and mixtures of two or more thereof.

15. The laminate of claim 1 wherein said skin layer comprises at least one copolymer or terpolymer selected from the group consisting of ethylene/vinyl acetate copolymer; ethylene/methyl acrylate copolymer; ethylene/ethylacrylate copolymer; ethylene/butyl acrylate copolymer; ethylene/methacrylic acid copolymer; ethylene/acrylic acid copolymer; ethylene/methacrylic acid copolymer salts of sodium or zinc; acid-, anhydride- or acrylate-modified ethylene/vinyl acetate copolymer; acid- or anhydride-modified ethylene/acrylate copolymer; anhydride-modified low density polyethylene; anhydride-modified linear low density polyethylene; and mixtures of two or more thereof.

16. The laminate of claim 1 wherein said skin layer comprises at least one ethylene/vinyl acetate copolymer wherein the vinyl acetate content of said copolymer is at least about 22 percent by weight.

17. The laminate of claim 1 wherein said core layer further comprises a pigment, adhesive material, light stabilizer, nucleating agent, or combination of two or more thereof.

18. The laminate of claim 17 wherein said nucleating agent is selected from the group consisting of dibenzidiene sorbitol, sodium benzoate and carboxylic acid.

19. The laminate of claim 1 wherein said skin layer further comprise an adhesive material, slip additive, light stabilizer or combination of two or more thereof.

20. The laminate of claim 5 wherein said another skin layer contains an antiblock additive.

21. The laminate of claim 1 wherein said image is comprised of pigment particles and/or dyes dispersed in a binder.

22. The laminate of claim 1 wherein said image is comprised of a binder, carbon black pigment and/or black dye, cyan pigment and/or dye, magenta pigment and/or dye, yellow pigment and/or dye, spot color pigment and/or dye, or a combination of two or more thereof.

23. The laminate of claim 1 wherein said image is comprised of at least one polymer selected from the group consisting of polyvinyl butyral resin, styrene resin, styrene-acrylic copolymer, styrene-butadiene copolymer, alkyd resin, rosin modified phenol resin, ethyl acrylate copolymer, polymethylacrylate resin, polyvinyl acetate resin, hydroxyethyl methacrylate resin, poly laurylmethacrylate copolymer, ionic polyester, and mixtures of two or more thereof.

24. The laminate of claim 1 wherein said dielectric layer is comprised of at least one polymer selected from the group consisting of polyester, polyvinyl acetate, polyvinyl chloride, polyvinyl butyral, polymethylmethyacrylate, styrenated acrylic, ethylene-vinyl alcohol copolymer, styrene-acrylonitrile copolymer, or a combination of two or more thereof.

25. The laminate of claim 2 wherein said conductive carrier sheet is comprised of a polymeric film forming material selected from the group consisting of anionic polymer, polystyrene sulfonic acid, styreneacrylate copolymer, polymeric quaternary ammonium compound, acrylic resin, acrylic copolymer resin, polyvinyl alcohol, cellulose resin, styrenemaleic anhydride copolymer, polyvinyl pyrrolidone, or a combination of two or more thereof.

26. The laminate of claim 2 wherein said conductive carrier sheet is comprised of at least one compound selected from the group consisting of antimony doped tin oxide, copper iodide, indium doped tin oxide, graphite, conductive clay, or a combination of two or more thereof.

27. The laminate of claim 2 wherein said conductive carrier sheet is comprised of paper coated with a conductive layer on one or both sides thereof.

28. The laminate of claim 12 wherein said release coating composition is a silicone release coating composition.

29. The laminate of claim 12 wherein said release coating composition is a room temperature or thermally cured composition.

30. The laminate of claim 12 wherein said release coating composition is a radiation-cured release coating composition.

31. The laminate of claim 12 wherein said pressure sensitive or heat-activatable adhesive composition comprises a rubber based adhesive, acrylic adhesive, vinyl ether adhesive, silicone adhesive, or combination of two or more thereof.

32. The laminate of claim 12 wherein said substrate is comprised of paper, polymeric film, or a combination thereof.

33. An imaged receptor laminate, comprising:

a thermoplastic core layer having a first side and a second side;

a thermoplastic skin layer overlying said first side of said core layer, said skin layer comprising a major amount of a thermoplastic copolymer or terpolymer derived from ethylene or propylene and a functional monomer selected from the group consisting of alkyl acrylate, acrylic acid, alkyl acrylic acid, and combinations of two or more thereof, said skin layer having a melting point in the range of about 50° C. to about 120° C., said core layer having a melting point that is higher than the melting point of said skin layer;

an electrostatically formed and developed image adhered to said skin layer; and a dielectric layer overlying said image and said skin layer.

34. An imaged receptor laminate, comprising:

a thermoplastic core layer having a first side and a second side;

a thermoplastic skin layer overlying said first side of said core layer, said skin layer comprising a major amount of a thermoplastic copolymer or terpolymer selected from the group consisting of ethylene/methyl acrylate copolymer; ethylene ethylacrylate copolymer; ethylene/butyl acrylate copolymer; ethylene/methacrylic acid copolymer; ethylene/acrylic acid copolymer; ethylene/methacrylic acid copolymer salts of sodium, lithium or zinc; acid- or anhydride-modified ethylene/acrylate copolymer; anhydride-modified low density polyethylene; anhydride-modified linear low density polyethylene; and mixtures of two or more thereof; said skin layer having a melting point in the range of about 50° C. to about 120° C., said core layer having a melting point that is higher than the melting point of said skin layer;

an electrostatically formed and developed image adhered to said skin layer; and a dielectric layer overlying said image and said skin layer.

* * * * *